US011631927B2

(12) United States Patent
Kajbaf

(10) Patent No.: US 11,631,927 B2
(45) Date of Patent: Apr. 18, 2023

(54) PROBE CALIBRATION SYSTEM AND METHOD FOR ELECTROMAGNETIC COMPATIBILITY TESTING

(71) Applicant: Amber Precision Instruments, Inc., San Jose, CA (US)

(72) Inventor: Hamed Kajbaf, San Jose, CA (US)

(73) Assignee: Amber Precision Instruments, Inc., San Jose, CA (US)

( * ) Notice: Subject to any disclaimer, the term of this patent is extended or adjusted under 35 U.S.C. 154(b) by 500 days.

(21) Appl. No.: 16/458,004

(22) Filed: Jun. 29, 2019

(65) Prior Publication Data

US 2020/0411934 A1 Dec. 31, 2020

(51) Int. Cl.

| | |
|---|---|
| ***H01P 3/12*** | (2006.01) |
| ***H01P 1/16*** | (2006.01) |
| ***H01P 5/08*** | (2006.01) |
| *H01P 11/00* | (2006.01) |

(52) U.S. Cl.

CPC ..... *H01P 1/16* (2013.01); *H01P 3/121* (2013.01); *H01P 5/08* (2013.01); *H01P 11/001* (2013.01)

(58) Field of Classification Search

CPC ..... H01P 1/16; H01P 3/12; H01P 5/08; H01P 11/001

See application file for complete search history.

(56) References Cited

U.S. PATENT DOCUMENTS

| | | | | |
|---|---|---|---|---|
| 5,920,240 | A * | 7/1999 | Alexanian | H01P 5/12 333/127 |
| 2002/0180570 | A1* | 12/2002 | Facer | C12N 13/00 333/248 |
| 2007/0024515 | A1* | 2/2007 | Suh | H01Q 13/10 343/767 |
| 2016/0018393 | A1* | 1/2016 | Brown | G01N 21/7703 435/287.1 |

* cited by examiner

*Primary Examiner* — Hasan Islam

(74) *Attorney, Agent, or Firm* — Loza & Loza, LLP; Thomas H. Ham

(57) ABSTRACT

Various aspects directed towards an integrated transverse electromagnetic (TEM) transmission line structure for probe calibration are disclosed. In one example, the integrated TEM transmission line structure includes a printed circuit board (PCB) and an air-dielectric coplanar waveguide (CPW). For this example, the air-dielectric CPW includes an air trace in a cutout slot of the PCB. In another example, a method is disclosed, which includes forming an air-dielectric CPW on a PCB in which the air-dielectric CPW includes an air trace in a cutout slot of the PCB. In a further example, an integrated TEM transmission line structure includes an air-dielectric CPW with an air trace. For this example, a first connector is electrically coupled to a first end of the air-dielectric CPW, and a second connector is electrically coupled to a second end of the air-dielectric CPW.

19 Claims, 16 Drawing Sheets

PROBE CALIBRATION SYSTEM AND METHOD FOR ELECTROMAGNETIC COMPATIBILITY TESTING

BACKGROUND OF THE INVENTION

Electromagnetic compatibility (EMC) testing is widely performed on equipment, such as complete systems, integrated circuits, printed circuit boards (PCBs) and other electronic modules, to determine whether the equipment radiates more radio frequency (RF) energy than either allowed by regulations or acceptable to avoid interference with wireless receivers, or to determine if the equipment is susceptible to electromagnetic (EM) disturbances. An EMC test may involve a number of different EM analyses. As an example, EMC testing may involve radiating electromagnetic waves at the equipment, measuring the emissions from the equipment or testing the immunity to electrostatic discharges (ESD).

Electromagnetic interference (EMI) testing is usually performed according to standards, e.g., the Federal Communications Commission (FCC) normally uses a semi-anechoic chamber or an open area test site to measure the fields in the far field region. Such methodology, however, provides little insight into the root cause of EMI problems. EMI analysis can also be performed by near-field scanning, i.e., measuring local electric or magnetic field around the equipment under test (EUT) to identify areas of strong electric or magnetic field. This near-field information may then assist in identifying the cause of an EMI problem of the EUT based on an implicit assumption that an area of strong field is the cause of the EMI problem.

An immunity or ESD analysis can also be performed by subjecting the EUT to strong electromagnetic fields (immunity) or injecting ESD currents into the EUT at different locations. Such analysis can then include determining whether an error has occurred because of the RF field or ESD current stress injected into the selected location.

The difference between the immunity analysis and the ESD analysis is the type of noise injected. Modulated RF signals are usually injected for the immunity analysis, whereas narrow pulses (having one or sub nanosecond rise time) are injected for an ESD analysis. Another relevant difference is that immunity analysis subjects the EUT to fields, most often in the far-field region of the transmitting antenna, while ESD testing injects currents directly into the EUT. Indirect ESD testing, which subjects the EUT only to the fields of the ESD, is also performed.

A method that provides better insight into the possible root cause of an immunity or susceptibility problem is susceptibility scanning. In this method, a probe is moved above the equipment (e.g., PCB, cables etc.) and a strong local field is caused by injecting pulses or RF signals into the probe. The probe is moved around the equipment and the reaction of the equipment is observed. This way, local areas of higher susceptibility can be identified.

The near-field EMI scanning and the near-field susceptibility scanning both identify local effects, which are difficult to connect to the system level performance of the EUT. Thus, strong local fields might be the cause of strong radiated emissions, and local areas of high susceptibility might be the reason for immunity or ESD problems as they show up if the complete system is tested in accordance to the standards, such as IEC 61000-4-3 (radiated immunity) or IEC 61000-4-2 (ESD).

Phase-resolved near-field scanning (NFS) has been widely used in electromagnetics and antenna research for many years. With the ongoing development of various technologies (e.g., high speed communication systems, cloud computing, autonomous vehicles, etc.), millimeter (mm) wavebands above 20 GHz are being intensively studied, and there is a great need for high frequency probes and a corresponding methodology for calibrating them. In most EMC near-field scanning systems, a probe (or a set of probes) captures a large set of near-field data on a surface plane close to the EUT. For example, an E-field probe or an H-field probe can be used to visualize the E-field or the H-field near-field distribution over an EUT.

Various probe calibration methods suitable for different frequency ranges are well known in the art including, for example, the different calibration methods and their typical frequency ranges disclosed in the Institute of Electrical and Electronics Engineers (IEEE) standards (See e.g., IEEE Standard 1309-2013), as well as methods disclosed by the International Electrotechnical Commission (IEC) (See e.g., IEC 61000-4-20 Annex E which discusses E-field probe calibration in transverse electromagnetic (TEM) waveguides).

Previous work has shown that referring a measured voltage to the known fields of a 50Ω transmission line (TL) is an effective method for calculating the probe factor. If the measurements are done with a Vector Network Analyzer (VNA) (e.g., the electrical analyzing instrument 110 illustrated in FIG. 1), the probe factor (PF) may be given by:

$$PF = \frac{ref}{S_{21}}$$

where ref is the normalized near-field strength (E or H) from a simulation at a given input voltage and at a given height above the TL:

$$ref = \frac{Near-field_{stimulation}}{V_{stimulation}}$$

Here, it should be appreciated that a "pure" TEM mode is generally desirable for calibration since a pure TEM is frequency-independent and the field components are well defined. However, it should be further appreciated that, although a physical structure can be pure TEM, any given structure will always have frequency limitations since transitions and inhomogeneity cause non-TEM modes (e.g., a transition from connector to transmission line would create some non-TEM mode behavior). Therefore, in the physical world, the desired features of a transmission line for calibration could generally be prioritized as follows:

1) Well defined field components (i.e., the near-field should be orthogonal to the direction of propagation and there should be no longitudinal component).
2) The near-field amplitude along a line across the TL should be as frequency-independent as possible.
3) Impedance matched in order to avoid reflections. If reflections arise, the calibration probe can measure the field along the line and relate the average to the average in the simulation.

It should be noted that a simple microstrip can be used up to a few gigahertz (GHz), while a grounded coplanar waveguide (GCPW) generally performs better for higher frequencies. The inhomogeneous medium of a coplanar waveguide (CPW), however, undesirably causes non-TEM behavior, wherein calibration is more difficult with non-TEM modes (e.g., frequency-dependent) and more inaccurate because of the longitudinal field component.

Accordingly, there is a need for a transmission line system and method for probe calibration that comes as close as possible to exhibiting pure TEM line behavior.

SUMMARY OF THE INVENTION

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

Various aspects directed towards a transmission line for probe calibration are disclosed. In a particular example, an integrated transverse electromagnetic (TEM) transmission line structure for probe calibration is disclosed, which includes a printed circuit board (PCB) and an air-dielectric coplanar waveguide (CPW). For this embodiment, the air-dielectric CPW includes an air trace in a cutout slot of the PCB.

In another aspect of the disclosure, a method for probe calibration is disclosed, which comprises forming a first trace on one end of an integrated TEM transmission line structure, and a second trace on an opposite end of the integrated TEM transmission line structure. The method further comprises forming a PCB and forming an air-dielectric CPW on the PCB. For this embodiment, the air-dielectric CPW includes an air trace in a cutout slot of the PCB.

In yet another aspect of the disclosure, a system for probe calibration is disclosed, which includes an air-dielectric CPW with an air trace. For this embodiment, a first connector is electrically coupled to a first end of the air-dielectric CPW, and a second connector is electrically coupled to a second end of the air-dielectric CPW. In a particular aspect of this embodiment, the system further includes a first grounded CPW (GCPW) in between a first end of the air-dielectric CPW and the first connector, and a second GCPW in between a second end of the air-dielectric CPW and the second connector. Within such embodiment, the first GCPW includes a first trace aligned with the air trace, and the second GCPW includes a second trace aligned with the air trace.

Other aspects and advantages of the present invention will become apparent from the following detailed description, taken in conjunction with the accompanying drawings, illustrated by way of example of the principles of the invention.

DETAILED DESCRIPTION

Overview

With the ongoing development of various technologies (e.g., fifth generation (5G) wireless communication systems, radar systems, cloud computing, Internet-of-Things (IoT), autonomous vehicles, etc.) frequencies as high as 40 gigahertz (GHz) have become relevant for electromagnetic interference (EMI) near-field scanning. Aspects disclosed herein are directed towards a transmission line for probe calibration that includes an air-dielectric coplanar waveguide (CPW). Because air is a homogeneous dielectric, the transmission line structure disclosed herein becomes an almost pure transverse electromagnetic (TEM) transmission line, which is preferable for probe calibration to a coplanar waveguide. Moreover, the air-dielectric CPW design disclosed herein is particularly desirable for high frequency probe calibration since it provides a more pure TEM structure relative to TEM structures that utilize a conventional CPW.

Exemplary Near-Field Scanning System

Figure 1:
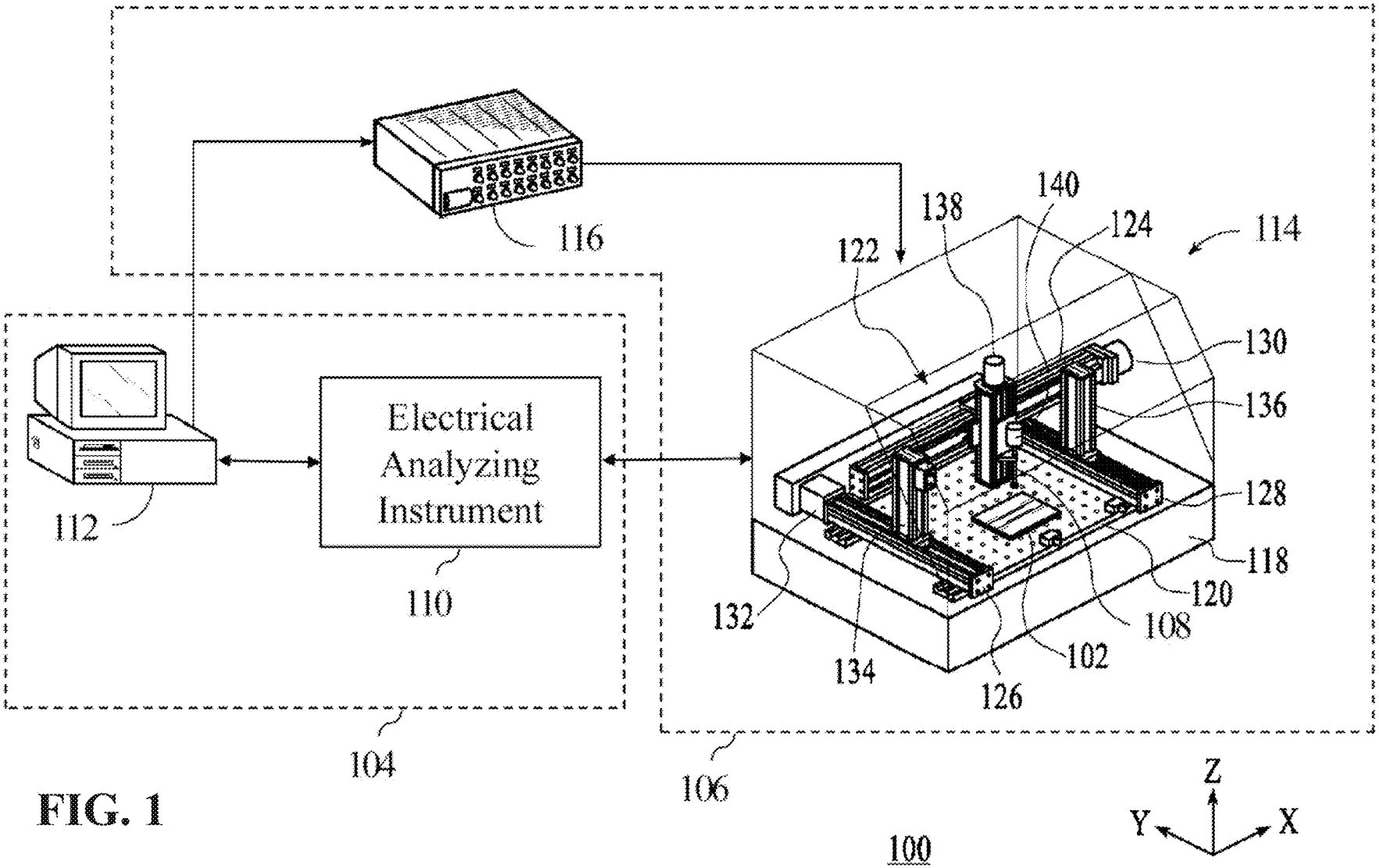
FIG. 1 is a diagram of a near-field scanning system in accordance with an embodiment of the invention.

It should be appreciated that the transverse electromagnetic (TEM) transmission line structure disclosed herein can be used for any of various types of near-field measurements including, for example, emission and immunity near-field scanning purposes (e.g., electromagnetic interference (EMI) testing, electrostatic discharge (ESD) testing, current spreading (CSP), phase measurement (PHM), emission source microscopy (ESM), resonance testing, etc.). With reference to FIG. 1, an exemplary near-field scanning system 100 in accordance with aspects disclosed herein is provided. As illustrated, the near-field scanning system 100 includes a transverse electromagnetic (TEM) transmission line structure 102 configured to calibrate near-field probes used to measure an equipment under test (EUT), which can be an integrated circuit (IC), a printed circuit board (PCB) or any electronic device, module or system, in accordance with an embodiment of the invention is described. The challenge in electromagnetic compatibility (EMC) analysis (both for emission and immunity near-field measurements) is often locating the source of emissions, the coupling paths, and the antennas. The most basic coupling theory for EMI predicts a broadband or linear increase of the coupling strength with increasing frequency. These models, however, do not intend to take the complexity of real systems into account. Their use lies in the illustration of basic principles, and their direct application is limited to simple cases on PCBs or cases with well controlled field structures as they can be found in TEM cell tests.

In some embodiments, the electrical analyzing instrument 110 is a network analyzer 110, in particular, a vector network analyzer. Thus, the electrical analyzing instrument 110 is referred to herein as a network analyzer. In these embodiments, the electrical analyzing instrument 110 can be one of many commercially available vector network analyzers. However, in related embodiments, the electrical analyzing instrument 110 may be a spectrum analyzer with a tracking generator or a spectrum analyzer with a radio frequency (RF) generator, or an RF source and an oscilloscope.

The motor driver 116 of the automatic scanning subsystem 106 is designed to provide driving signals to the probe positioning mechanism 114 so that the probe 108 can be displaced to desired testing locations of the EUT and/or be rotated to desired rotational positions. The motor driver 116 is electrically connected to the motors 130 and 132 of the probe positioning mechanism 114 to provide driving signals to these motors so that the probe 108 can be linearly displaced along the X-axis and the Y-axis. The motor driver 116 is also electrically connected to the motors 138 and 140 of the scan head 122 to provide driving signals to these motors so that the probe 108 can be vertically moved along the Z-axis and be rotated about the Z-axis. In an embodiment, the motor driver 116 is controlled by the processing device 112. Thus, the processing device 112 is able to track the movements of the probe 108 that is being displaced by the automatic scanning subsystem 106.

Exemplary Transverse Electromagnetic (TEM) Transmission Line Embodiment

Figure 2:
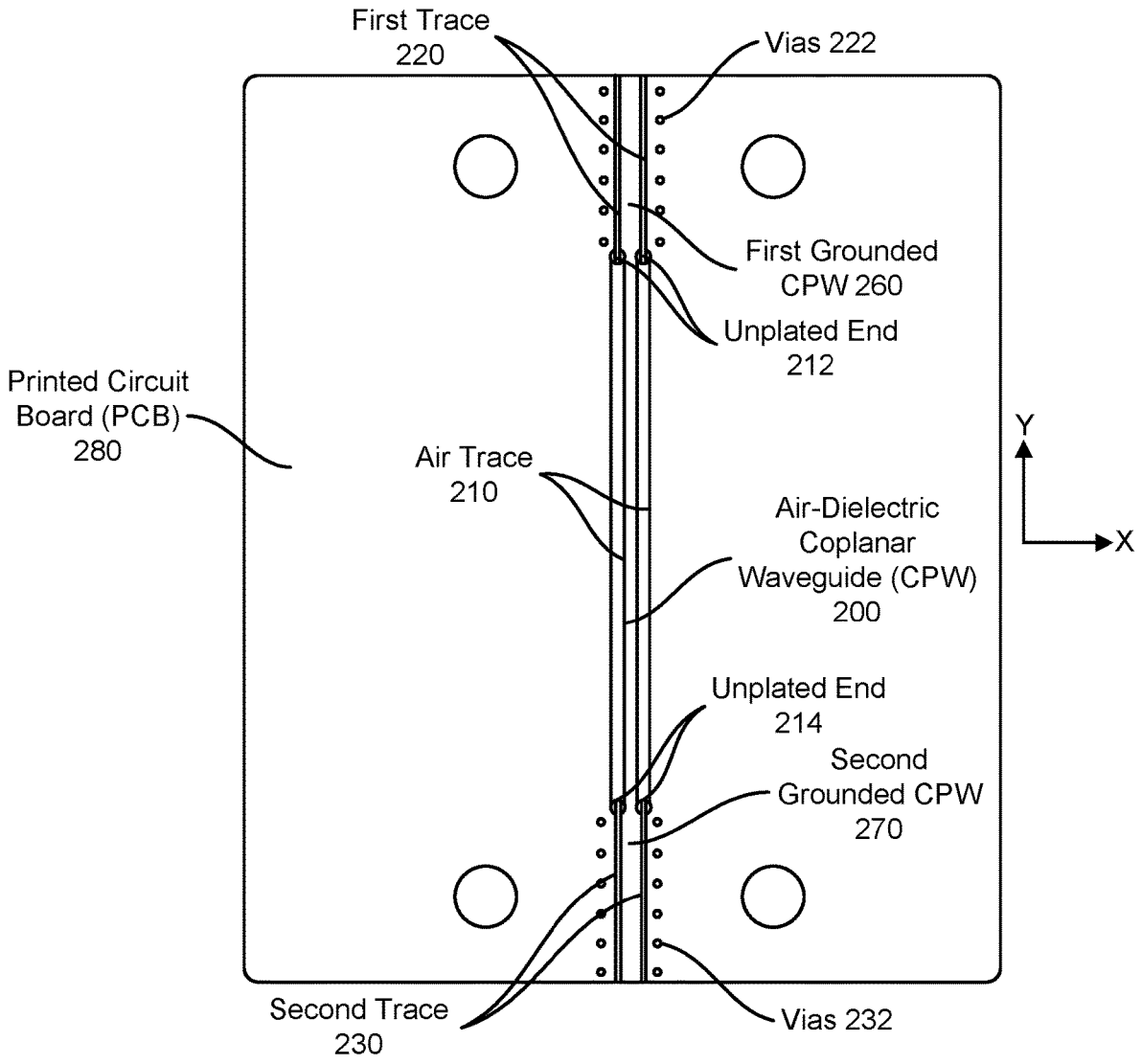
FIG. 2 is a top view of an exemplary integrated transverse electromagnetic (TEM) transmission line structure with an air-dielectric coplanar waveguide (CPW) in accordance with an embodiment of the invention.
Figure 3:
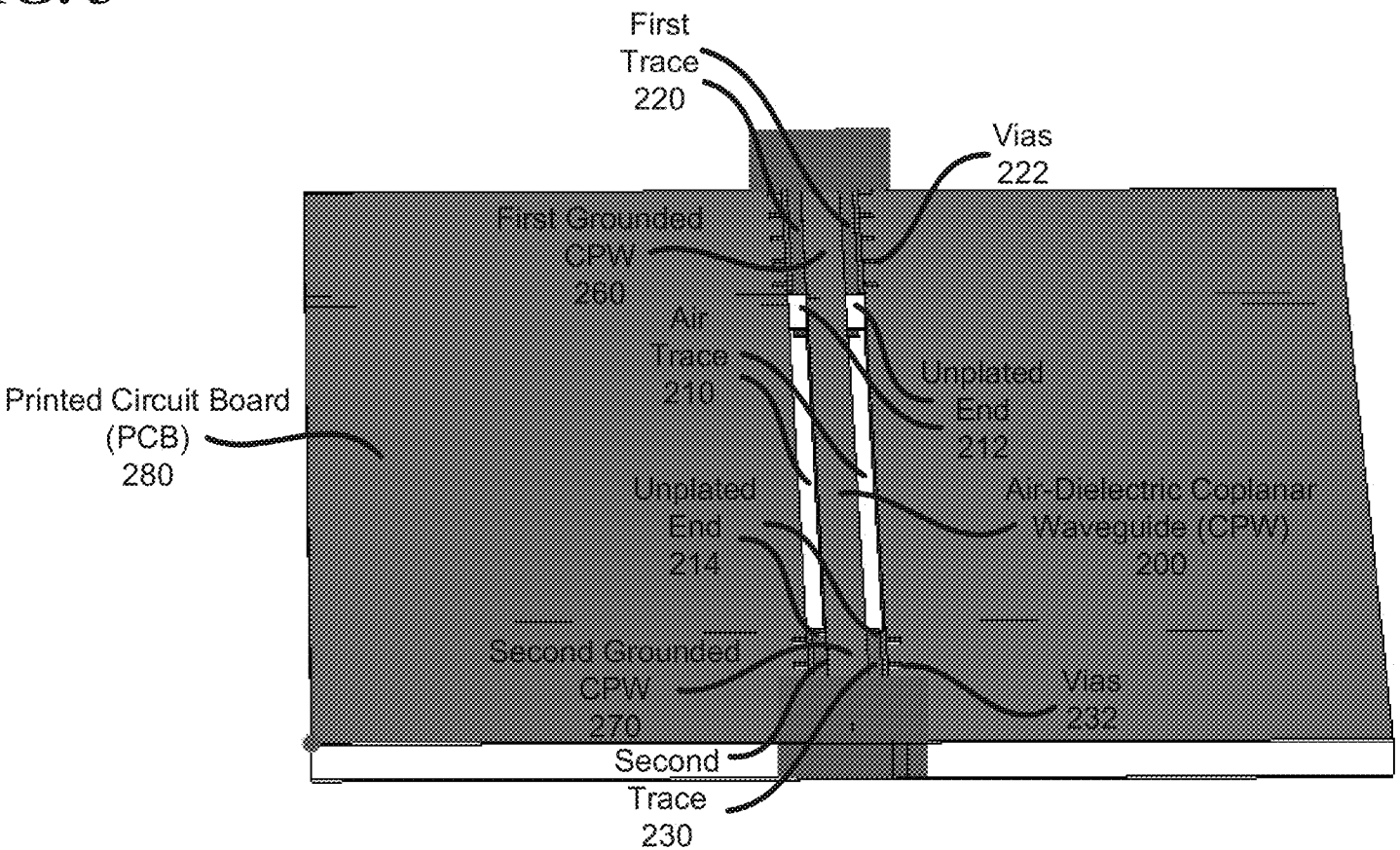
FIG. 3 is a perspective view of the exemplary integrated TEM transmission line structure illustrated in FIG. 2.
Figure 4:
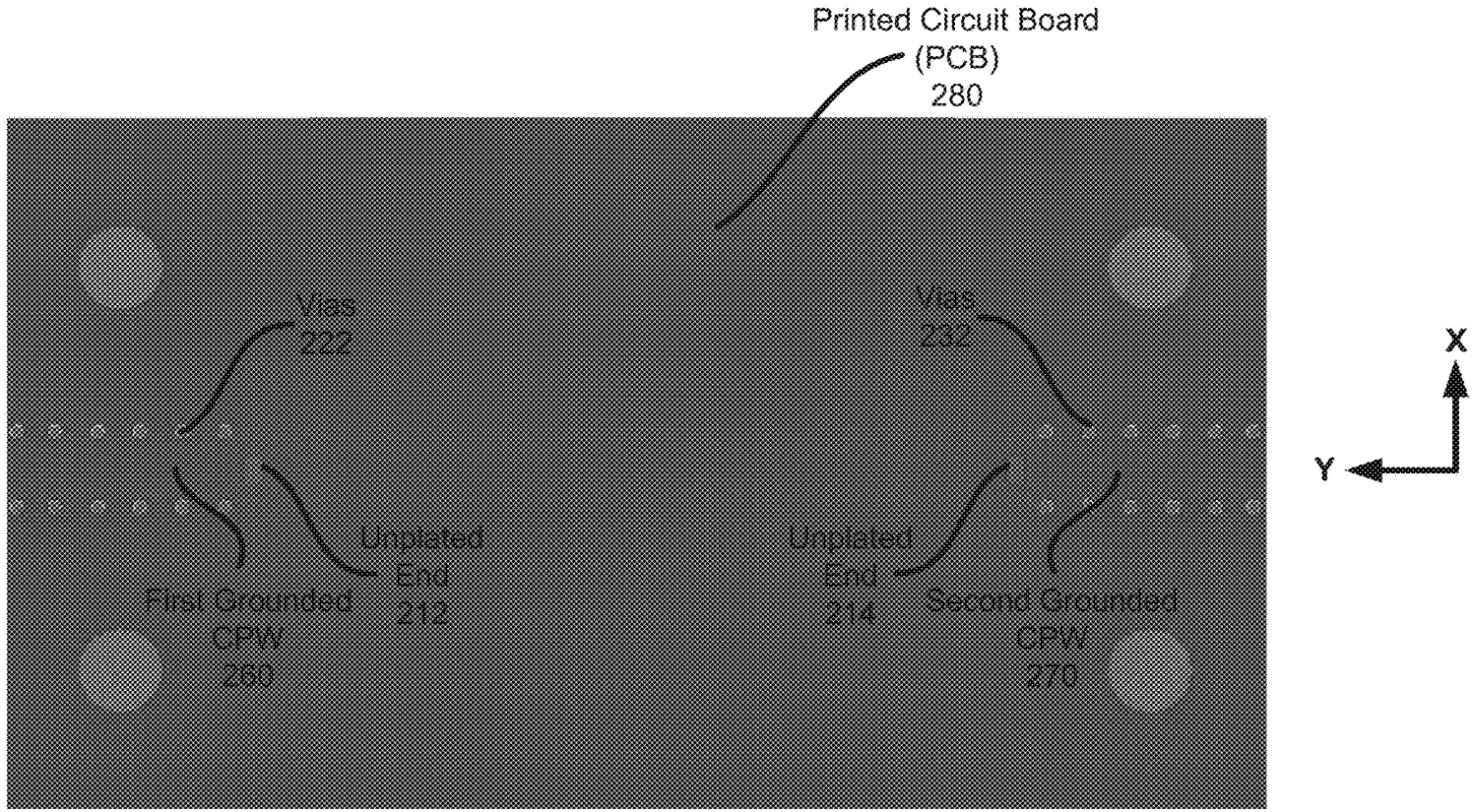
FIG. 4 is a bottom view of the exemplary integrated TEM transmission line structure illustrated in FIG. 2.

Referring next to FIGS. 2-4, various views (top, perspective, and bottom, respectively) of an exemplary TEM transmission line structure with an air-dielectric coplanar waveguide (CPW) in accordance with aspects disclosed herein are provided. As illustrated, it is contemplated that an integrated TEM transmission line structure comprises an air-dielectric coplanar waveguide (CPW) 200 formed on a printed circuit board (PCB) 280, wherein the air-dielectric CPW 200 may include an air trace 210 in a cutout slot of the PCB 280. It is also contemplated that the TEM transmission line structure may further include a first grounded CPW (GCPW) 260 on a first end of the air-dielectric CPW 200, wherein the first GCPW 260 includes a first trace 220 aligned with the air trace 210, and a second GCPW 270 on a second end of the air-dielectric CPW 200, wherein the second grounded CPW 270 includes a second trace 230 aligned with the air trace 210. It is further contemplated that the air-dielectric CPW 200 may comprise an air trace 210 in a cutout slot of the PCB 280. The first trace 220 and second trace 230 may also include a corresponding set of vias, 222 and 232, respectively, as shown.

In a particular aspect disclosed herein, the air trace 210 is plated (e.g., a copper plating) except on each of a first end of the cutout slot and a second end of the cutout slot. Namely, for this embodiment, it is contemplated that each of the first end of the cutout slot and the second end of the cutout slot are un-plated (i.e., un-plated end 212 and un-plated end 214, respectively). As used herein, it should be appreciated that "plating" (e.g., edge-plating) is defined as the process of adding metal to the sides of a printed circuit board (PCB). It should be further appreciated that embodiments are also contemplated in which the air trace 210 is un-plated.

Various other aspects of the air-dielectric CPW 200 are also contemplated. For instance, in order to avoid reflections, it is contemplated that the impedance of the air-dielectric CPW 200 is matched with the impedance of the first GCPW 260 and/or second GCPW 270. Similarly, since at least one connector may be electrically coupled to either the first GCPW 260 or the second GCPW 270 (See e.g., FIGS. 5-6), it is contemplated that the impedance of the at least one connector may be matched with the impedance of the first GCPW 260 and/or second GCPW 270 (i.e., to avoid reflections caused by the transition from the connector to the first GCPW 260 and/or second GCPW 270). Alternatively, it should be appreciated that connectors may be electrically coupled directly to a first and opposite end of the air-dielectric CPW 200 (i.e., a structure without the first GCPW 260 or the second GCPW 270), wherein the impedance of the connectors may be matched with the impedance of the air-dielectric CPW 200.

In another aspect of the disclosure, the dimensions of the integrated TEM transmission line structure are carefully selected so as to facilitate near-pure TEM behavior. For instance, dimensions may be selected to facilitate maintaining one of an electric near-field or a magnetic near-field having an orthogonal component across the air trace 210 and a minimized longitudinal component across the air trace 210. Similarly, the dimensions may be selected to facilitate maintaining one of an electric near-field or a magnetic near-field having an amplitude along a line across the first and second GCPWs, 260 and 270, wherein the dimensions further facilitate minimizing a frequency dependence of the amplitude.

Figure 5:
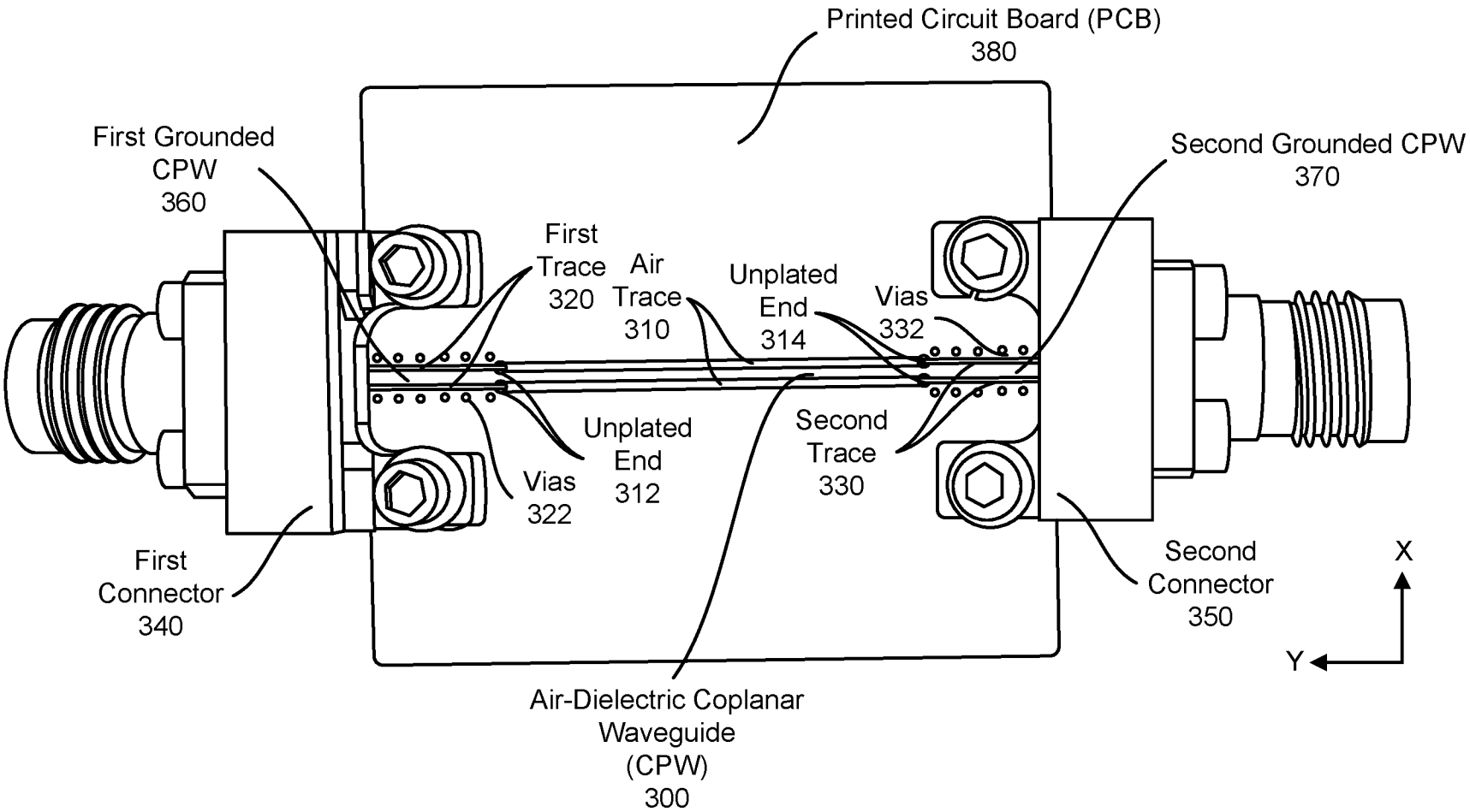
FIG. 5 is a top view of the exemplary integrated TEM transmission line structure illustrated in FIG. 2 configured with connectors in accordance with an embodiment of the invention.
Figure 6:
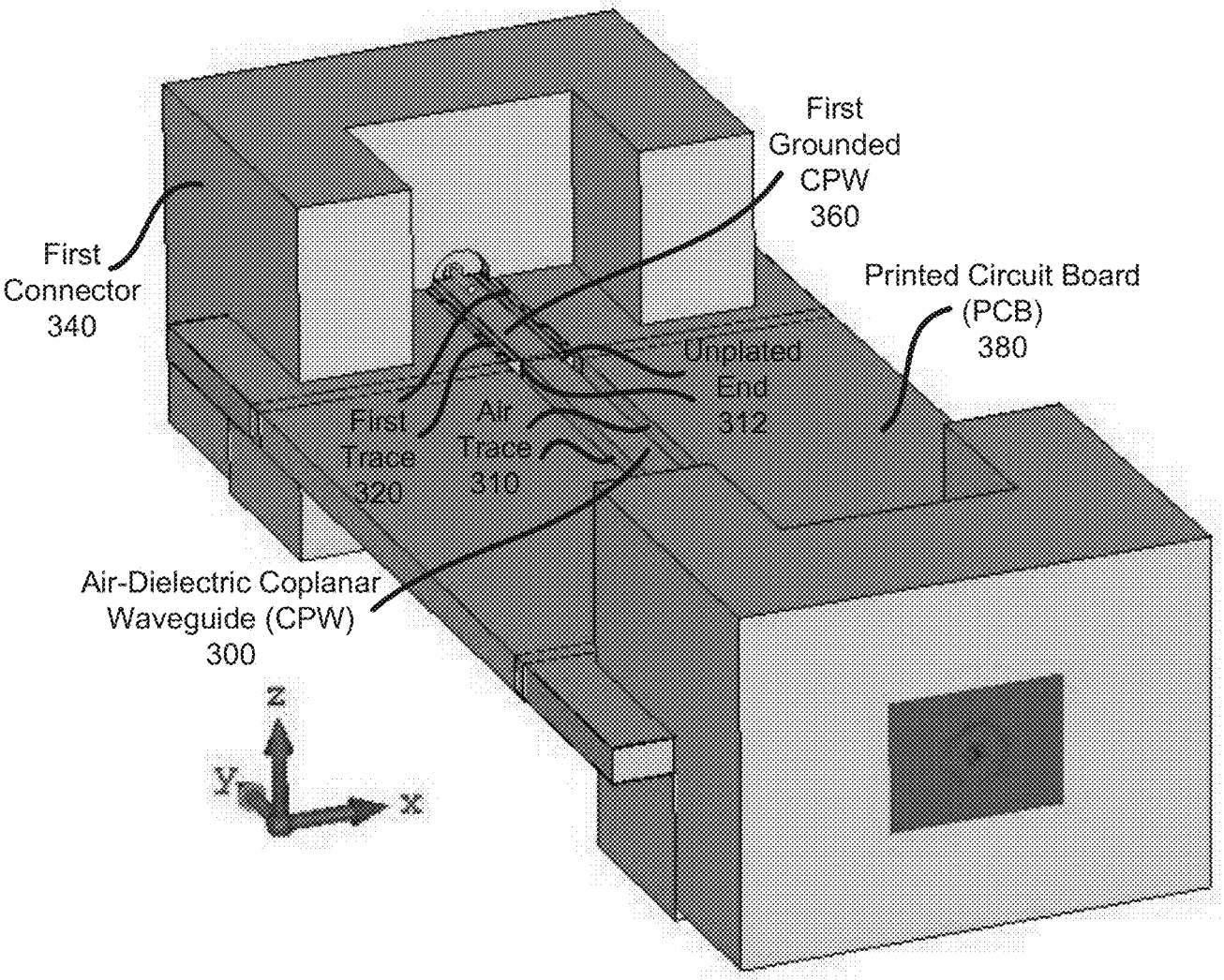
FIG. 6 is a perspective view of the exemplary integrated TEM transmission line structure illustrated in FIG. 5.

Referring next to FIGS. 5-6, a top view and perspective view are respectively provided of the exemplary integrated TEM transmission line structure illustrated in FIGS. 2-4 configured with connectors in accordance with aspects disclosed herein. As illustrated, it is contemplated that a TEM transmission line structure may comprise an air-dielectric CPW 300 formed on a PCB 380, wherein the air-dielectric CPW 300 may include an air trace 310 in a cutout slot of the PCB 380. Here, it is again contemplated that the TEM transmission line structure may further include a first GCPW 360 on a first end of the air-dielectric CPW 300, wherein the first GCPW 360 includes a first trace 320 aligned with the air trace 310, and a second GCPW 370 on a second end of the air-dielectric CPW 300, wherein the second GCPW 370 includes a second trace 330 aligned with the air trace 310. The first trace 320 and second trace 330 may also include a corresponding set of vias, 322 and 332, respectively, as shown. As illustrated, the system may also include a first connector 340 electrically coupled to the first GCPW 360, and a second connector 350 electrically coupled to the second GCPW 370.

In general, it is contemplated that the first and second GCPWs, 360 and 370, are not plated, whereas the air trace 310 may or may not be plated. For instance, in a particular aspect disclosed herein, the air trace 310 is plated (e.g., a copper plating) except on each of a first end of the cutout slot and a second end of the cutout slot. Namely, for this embodiment, it is contemplated that each of the first end of the cutout slot and the second end of the cutout slot are un-plated (i.e., un-plated end 312 and un-plated end 314, respectively).

In another aspect of the disclosure, the dimensions of the integrated TEM transmission line structure are again carefully selected so as to facilitate near-pure TEM behavior. For instance, to avoid reflections caused by the transition from the air-dielectric CPW 300 to the first and second GCPWs, 360 and 370, dimensions may be selected to facilitate an impedance match of the air-dielectric CPW 300 and the first and second GCPWs, 360 and 370. Similarly, to avoid reflections caused by the transition from the first and second GCPWs, 360 and 370, to either the first connector 340 or the second connector 350, the dimensions may be selected to facilitate an impedance match of the first connector 340 to the first GCPW 360, and an impedance match of the second connector 350 to the second GCPW 370.

In another aspect of the disclosure, the dimensions of the TEM transmission line structure are carefully selected so as to facilitate maintaining one of an electric near-field or a magnetic near-field having an orthogonal component across the air trace 310 and a minimized longitudinal component across the air trace 310. Similarly, the dimensions may be selected to facilitate maintaining one of an electric near-field or a magnetic near-field having an amplitude along a line across the first and second GCPWs, 360 and 370, wherein the dimensions further facilitate minimizing a frequency dependence of the amplitude.

Figure 7:
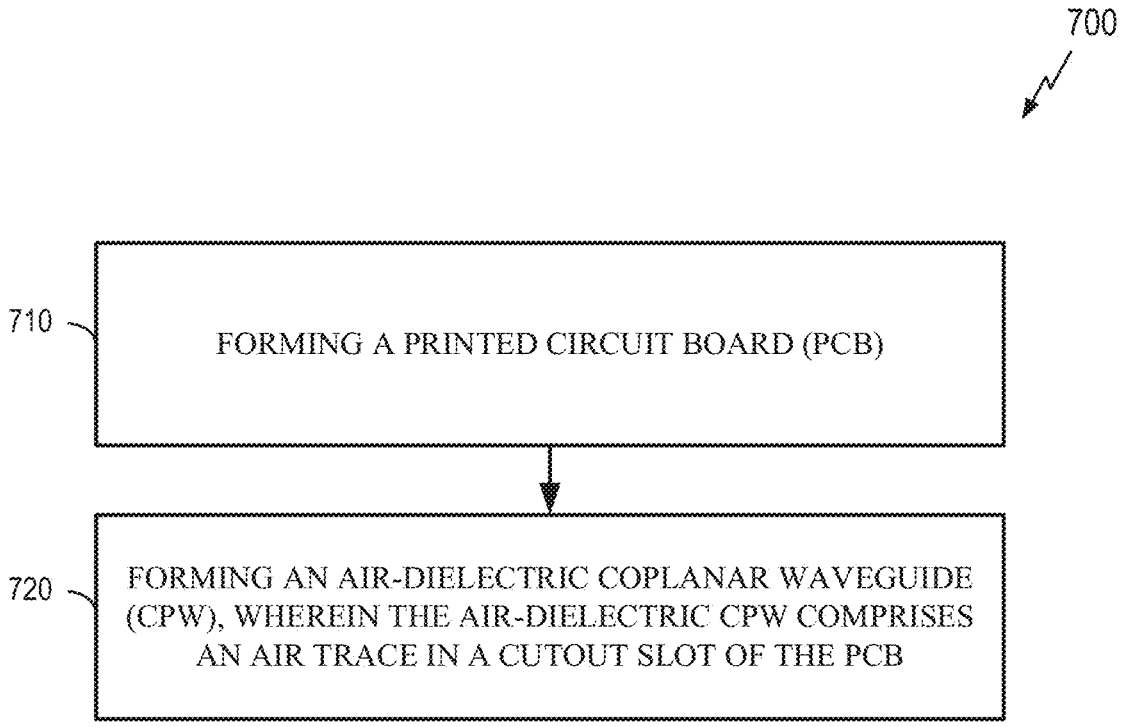
FIG. 7 is a flow diagram of an exemplary process for forming an air-dielectric CPW in accordance with an embodiment of the invention.

Referring next to FIG. 7, a flow chart is provided, which illustrates an exemplary process for forming a TEM transmission line structure with an air-dielectric CPW in accordance with some aspects of the disclosure. As described below, some or all illustrated features may be omitted in a particular implementation within the scope of the present disclosure, and some illustrated features may not be required for implementation of all embodiments. It should also be appreciated that the process 700 may be carried out by any suitable apparatus or means for carrying out the functions or algorithm described below.

Process 700 begins at block 710 with the forming of a PCB (e.g., PCB 280), and concludes with the forming of an air-dielectric CPW (e.g., air-dielectric CPW 200) on the PCB at block 720, wherein the air-dielectric CPW includes an air trace (e.g., air trace 210) formed in a cutout slot of the PCB. In a particular aspect disclosed herein, process 700 may further comprise forming a first GCPW (e.g., first GCPW 260) on a first end of the air-dielectric CPW, wherein the first GCPW includes a first trace (e.g., first trace 220) aligned with the air trace, and forming a second GCPW (e.g., second GCPW 270) on a second end of the air-dielectric CPW, wherein the second GCPW includes a second trace (e.g., second trace 230) aligned with the air trace.

It is also contemplated that process 700 may further comprise plating the air trace (e.g., a copper plating). Within such embodiment, it is contemplated that process 700 may further comprise the removal of each of a first plating and a second plating from each of a first end of the cutout slot (e.g., un-plated end 212) and a second end of the cutout slot (e.g., un-plated end 214).

Various other aspects of process 700 are also contemplated. For instance, in order to avoid reflections, it is contemplated that process 700 may further comprise matching the impedance of the air-dielectric CPW with the impedance of the first and second GCPWs. Similarly, since process 700 may also comprise electrically coupling a connector to either end of the air-dielectric CPW (e.g., either directly to either end of the air-dielectric CPW, or via the first and second GCPWs), process 700 may further comprise matching the impedance of the connectors with the impedance of the air-dielectric CPW (i.e., to avoid reflections caused by a transition from the connector to the air-dielectric CPW, if the connectors are directly connected to the air-dielectric CPW), and/or matching the impedance of the connectors with the impedance of the first and second GCPWs (i.e., to avoid reflections caused by a transition from the connector to the first or second GCPW, if the connectors are connected to the air-dielectric CPW via the first and second GCPWs).

In another aspect of the disclosure, it is contemplated that process 700 may comprise selecting the dimensions of the integrated TEM transmission line structure so as to facilitate near-pure TEM behavior. For instance, the selecting of dimensions may facilitate maintaining one of an electric near-field or a magnetic near-field having an orthogonal component across the air trace and a minimized longitudinal component across the air trace. Similarly, the selecting of dimensions may facilitate maintaining one of an electric near-field or a magnetic near-field having an amplitude along a line across the first and second GCPWs to further facilitate minimizing a frequency dependence of the amplitude.

Exemplary Transverse Electromagnetic (TEM) Transmission Line Implementations

An exemplary implementation of aspects disclosed herein is now described with reference to components illustrated in FIGS. 5-6. For instance, in an exemplary implementation, a 2.4 millimeter (mm) connector (e.g., first connector 340 and/or second connector 350) is attached to a 1 mm thick PCB (e.g., PCB 380) with a 1 mm wide trace (e.g., first trace 320 and/or second trace 330). The trace (e.g., first trace 320 and/or second trace 330) continues in an air trace (e.g., air trace 310) formed by a cutout slot in the PCB, which may be plated with copper. By carefully tuning and selecting various aspects of the TEM transmission line structure based on transmission line theory (e.g., thickness of PCB, width of traces, width of air gap, tolerance of machining, choice of connectors, etc.), a transmission line with a characteristic impedance of 50Ω with low loss and almost pure TEM may be obtained. Here, it should be noted that the structure disclosed herein can be PCB-manufactured, which desirably avoids the possibility of human error associated with man-made craftsmanship. With PCB manufacturing, however, it should also be noted that the cutout slot may be completely plated, which would cause the trace to be short circuited to ground. Hence, aspects disclosed herein contemplate removing (e.g., drilling away) the plating at the ends of the cutout slot (e.g., forming un-plated end 312 and un-plated end 314).

It should be noted that software was used to simulate the above exemplary implementation of the TEM transmission line structure disclosed herein. In a particular simulation, input power was normalized to 1 watt, and 6 million mesh cells were used. With reference to FIGS. 5-6, it should also be noted that the GCPW was excited via waveguide ports coupled to the coaxial inner part of a first and second connector with a diameter of 1.61 mm.

Based on the aforementioned desired features of a transmission line for calibration (i.e., well defined field components; frequency-independent near-field amplitude; and impedance matched), the calibration structure for this particular implementation was evaluated with respect to the longitudinal field component (non-TEM mode), S-parameters, and amplitude across and along the air trace. Time domain reflectometry (TDR) was used in measurements to analyze imperfections in the structure. The near-field was evaluated 1 mm above the transmission line, which is a typical scanning height for high frequency (up to EHF band of radio frequencies) applications. Here, it should be noted that, although a 1 mm height was used, other heights may also be used.

Figure 8:
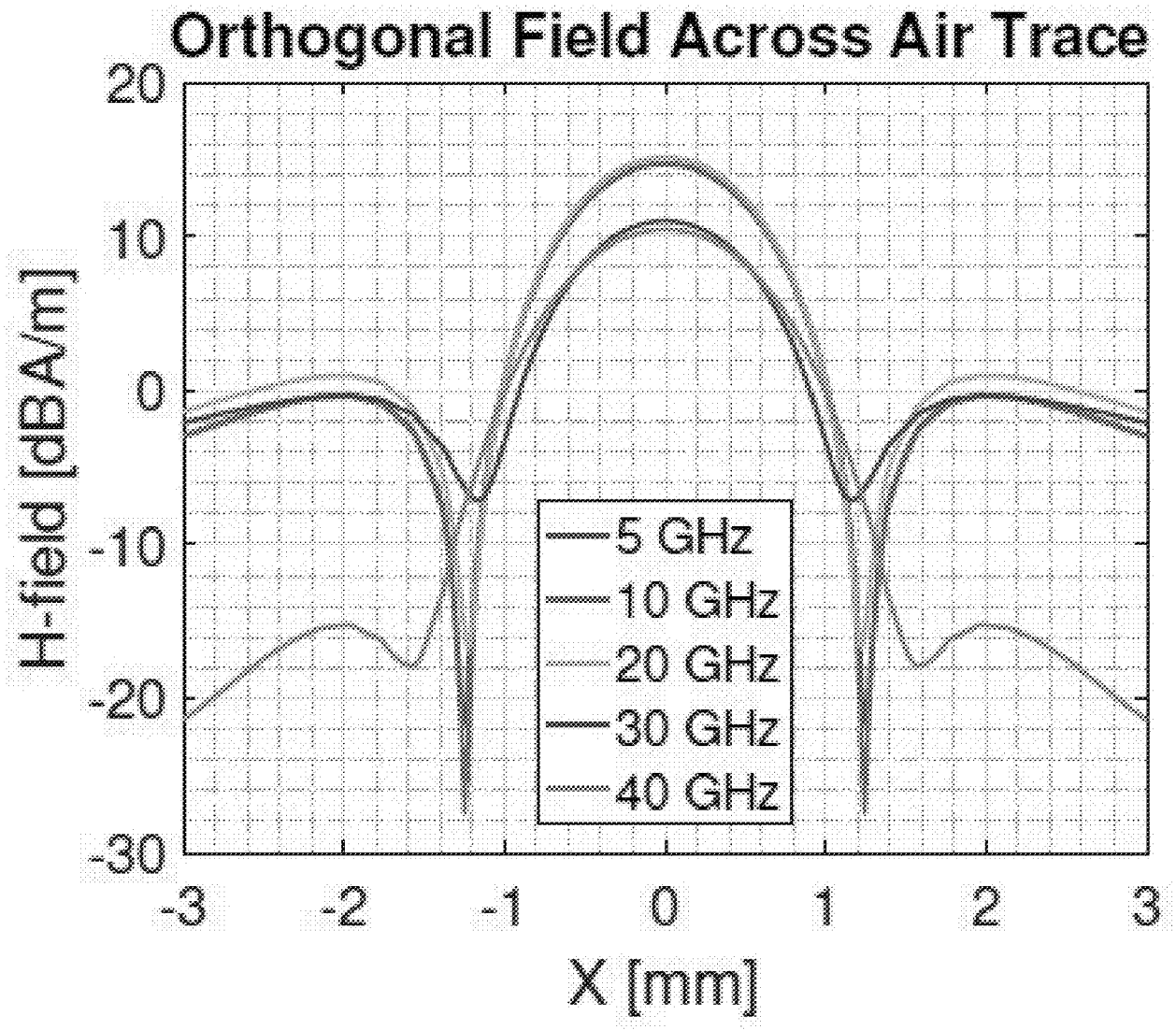
FIG. 8 is a graph of simulation results illustrating the tangential field across an exemplary air trace for various frequencies in accordance with an embodiment of the invention.
Figure 9:
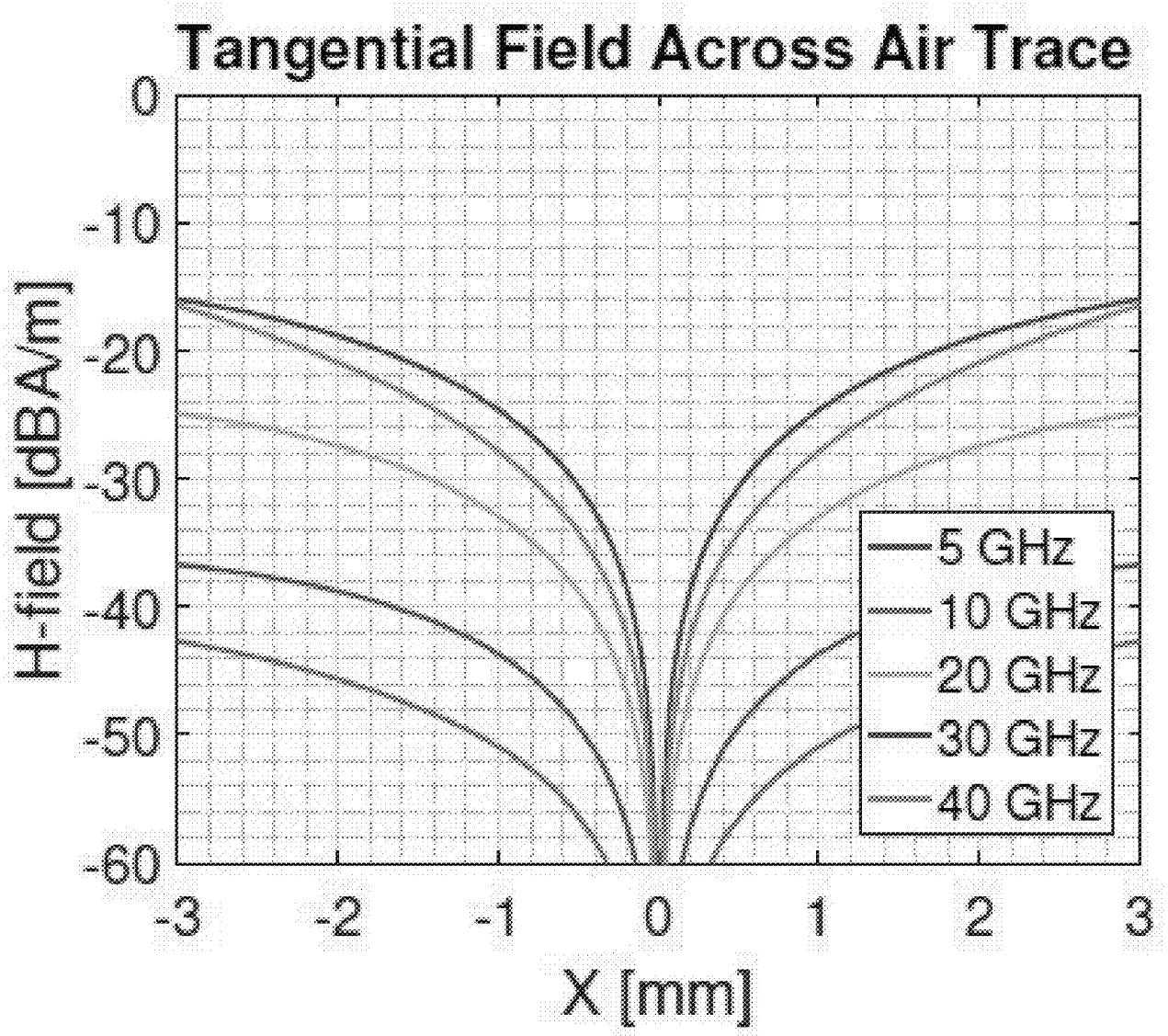
FIG. 9 is a graph of simulation results illustrating the longitudinal field across an exemplary air trace for various frequencies in accordance with an embodiment of the invention.

Referring next to FIGS. 8-9, simulation results are provided respectively illustrating the orthogonal and longitudinal fields across the air trace for various frequencies. As illustrated, the air-dielectric CPW yields desirable results up to 30 GHz. Orthogonal fields across the air trace are frequency-independent up to the EHF band of radio frequencies, and the longitudinal field is negligible.

Figure 10:
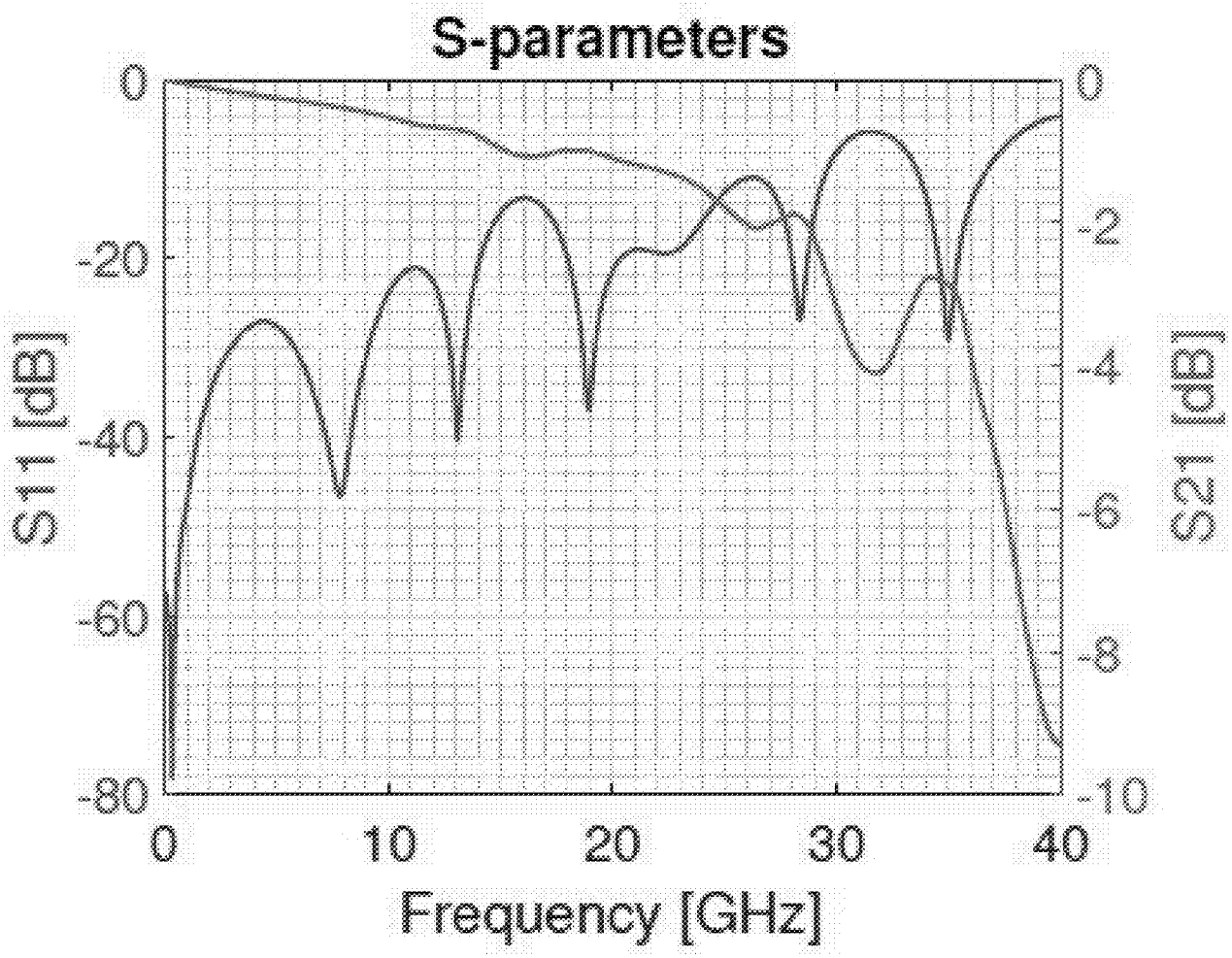
FIG. 10 is a graph of simulation results illustrating the $S_{11}$ and $S_{21}$ parameters corresponding to an exemplary air trace in accordance with an embodiment of the invention.
Figure 11:
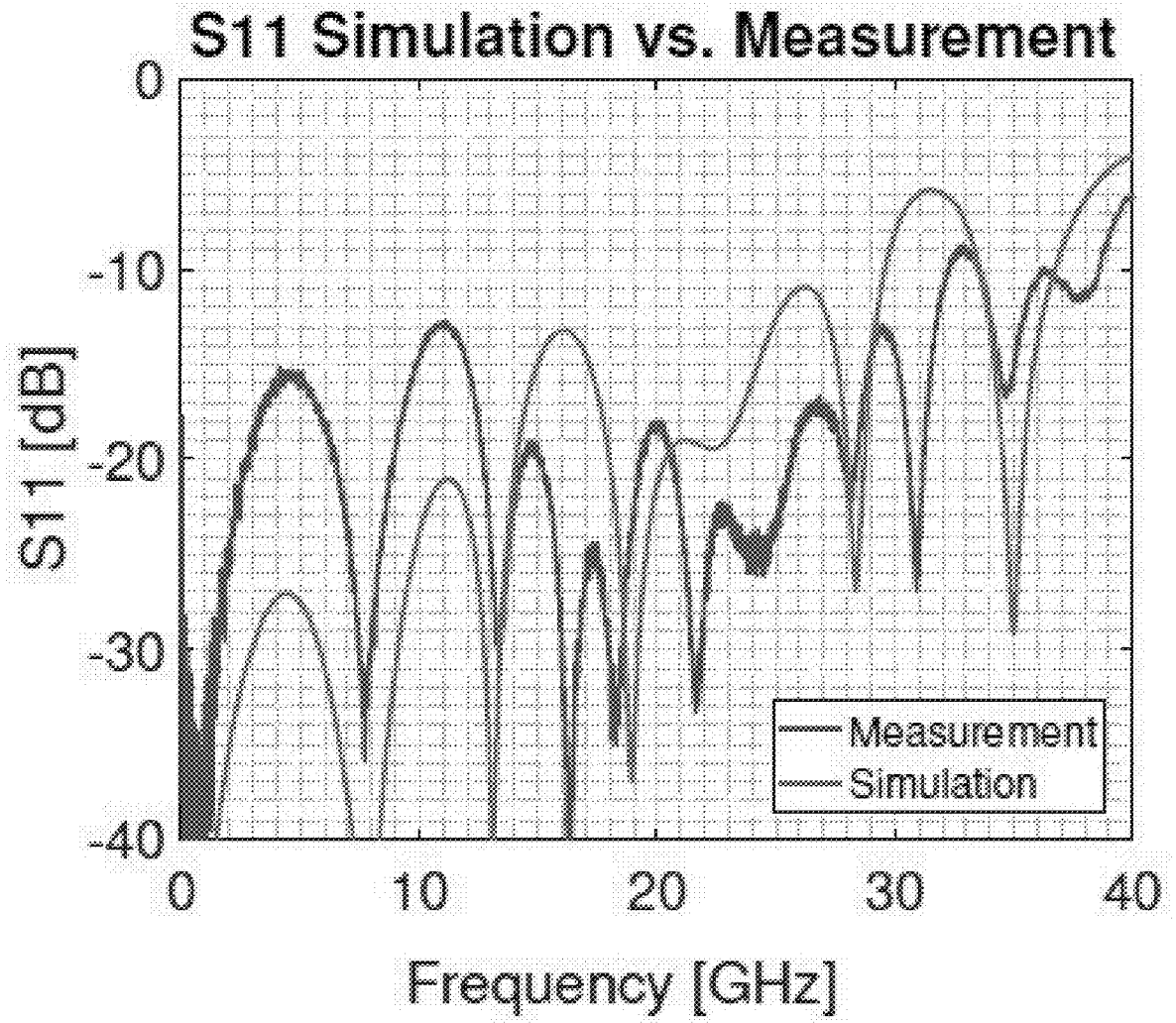
FIG. 11 is a graph illustrating a comparison between simulations and measurements of an $S_{11}$ parameter corresponding to an exemplary air trace in accordance with an embodiment of the invention.
Figure 12:
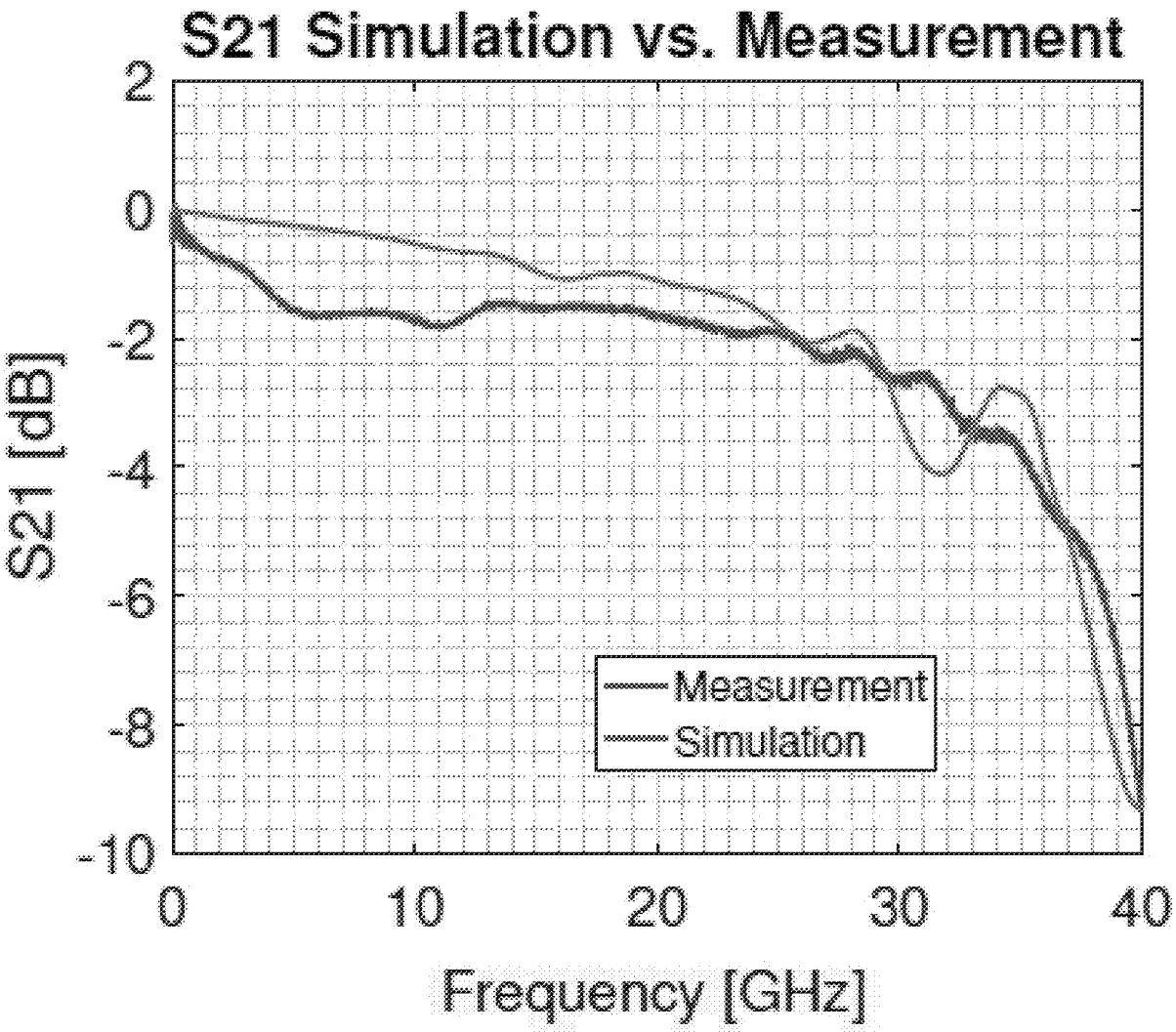
FIG. 12 is a graph illustrating a comparison between simulations and measurements of an $S_{21}$ parameter corresponding to an exemplary air trace in accordance with an embodiment of the invention.

Referring next to FIG. 10, simulation results are provided illustrating the $S_{11}$ and $S_{21}$ parameters corresponding to the air trace. A comparison between actual measurements and the simulations were also made. In FIGS. 11-12, for instance, a comparison between simulations and measurements for each of an $S_{11}$ and $S_{21}$ parameter corresponding to the air trace are respectively provided. As illustrated, although there are differences in amplitude, there is desirable agreement with trends.

Figure 13:
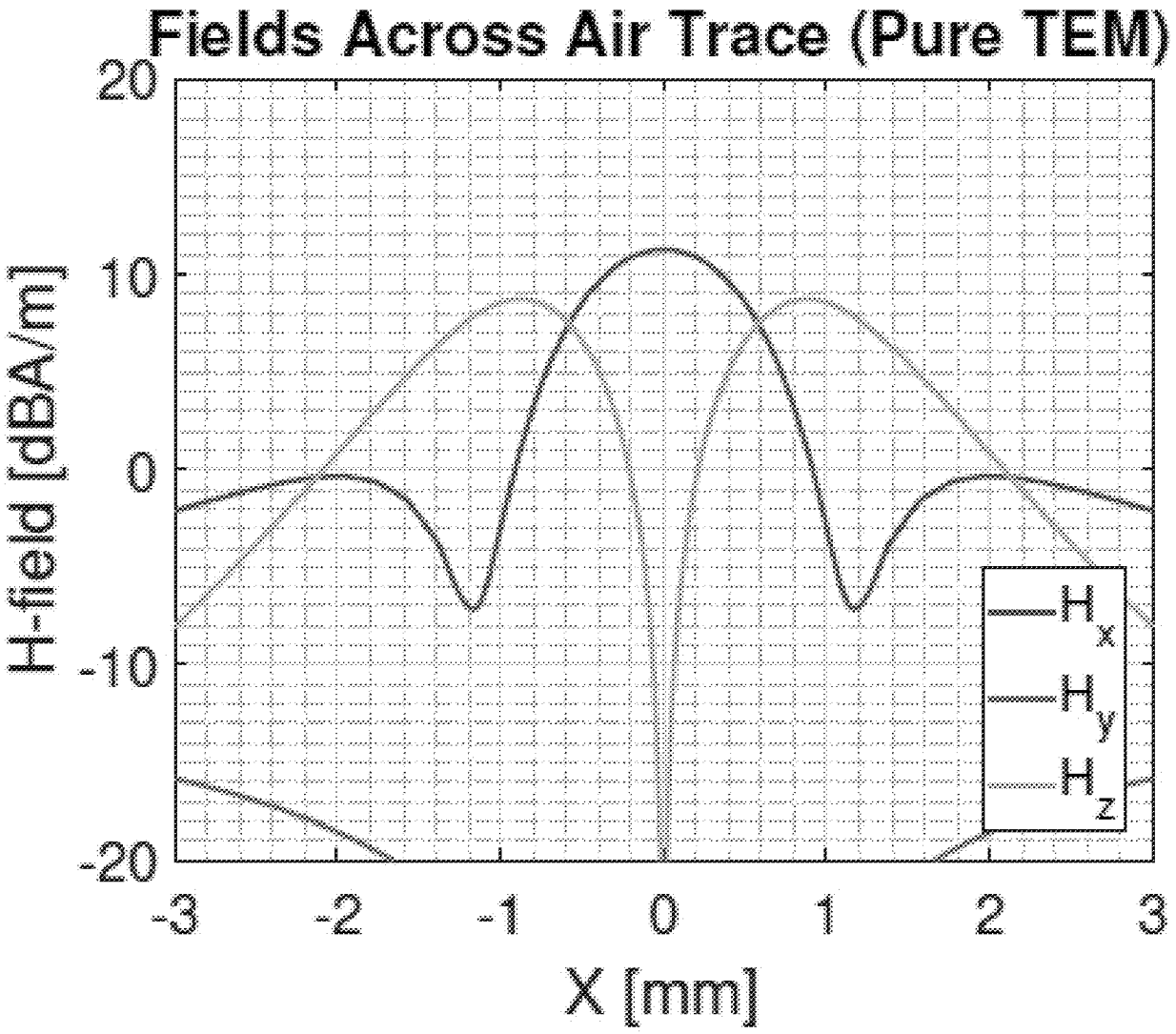
FIG. 13 is a graph of measurement results illustrating magnetic field components across an exemplary air-dielectric CPW in accordance with an embodiment of the invention.
Figure 14:
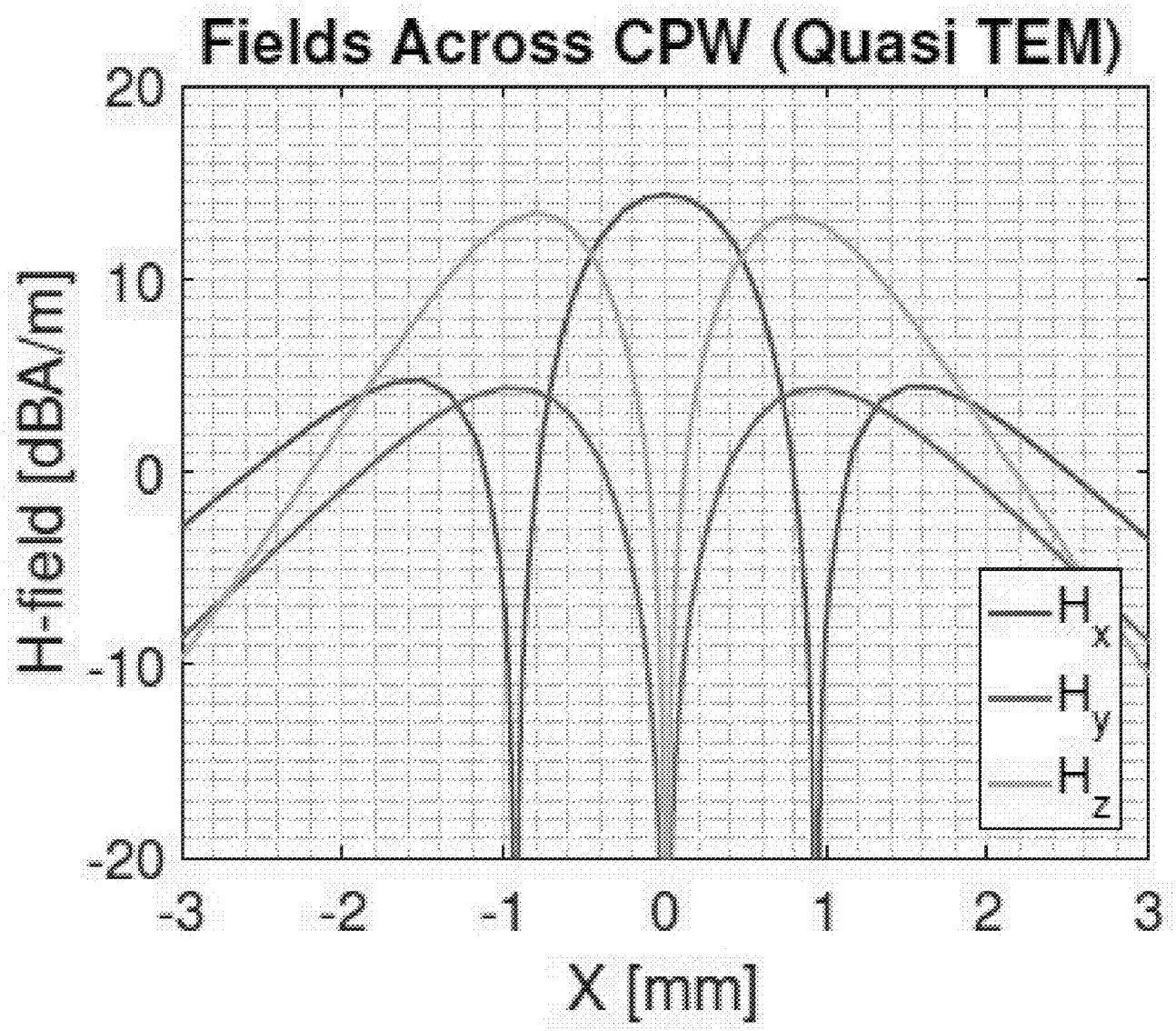
FIG. 14 is a graph of measurement results illustrating magnetic field components across a conventional CPW in accordance with an embodiment of the invention.

Comparisons were also made between the quasi-TEM behavior of the GCPW and the more pure TEM behavior of the air-dielectric CPW. For instance, FIG. 13 is a graph of measurement results illustrating magnetic field components across the air trace, whereas FIG. 14 illustrates measurements of magnetic field components across the grounded CPW. For this particular comparison, the H-field across a 0.762 mm GCPW is compared with the same field of a 1 mm thick air-dielectric CPW at 30 GHz. As illustrated, the $H_y$ (tangential component) of the air-dielectric CPW is negligible compared to the orthogonal fields ($H_x$ and $H_z$) at all points across the air-dielectric CPW. For the quasi-TEM GCPW, the amplitude of the $H_y$ component is comparable with the tangential components at x=−1 and x=1.

The measurements and simulations of the air-dielectric CPW disclosed herein, reveal that the transition between the GCPW and the air-dielectric CPW should be accounted for in order to avoid standing waves and loss. At 40 GHz, the wavelength in free space is 7.5 mm. With a PCB thickness of 1 mm, the length of the detour the return current has to travel in the transition is more than 1/10 of the wavelength. Hence, this distance is comparable with the wavelength. To overcome this problem, it is contemplated that the PCB thickness can be made thinner. For instance, the PCB may be designed with 0.8 mm and 0.6 mm thicknesses, and the air and substrate gaps may be adjusted to the thinner board in order to obtain a 50Ω characteristic impedance.

Figure 15:
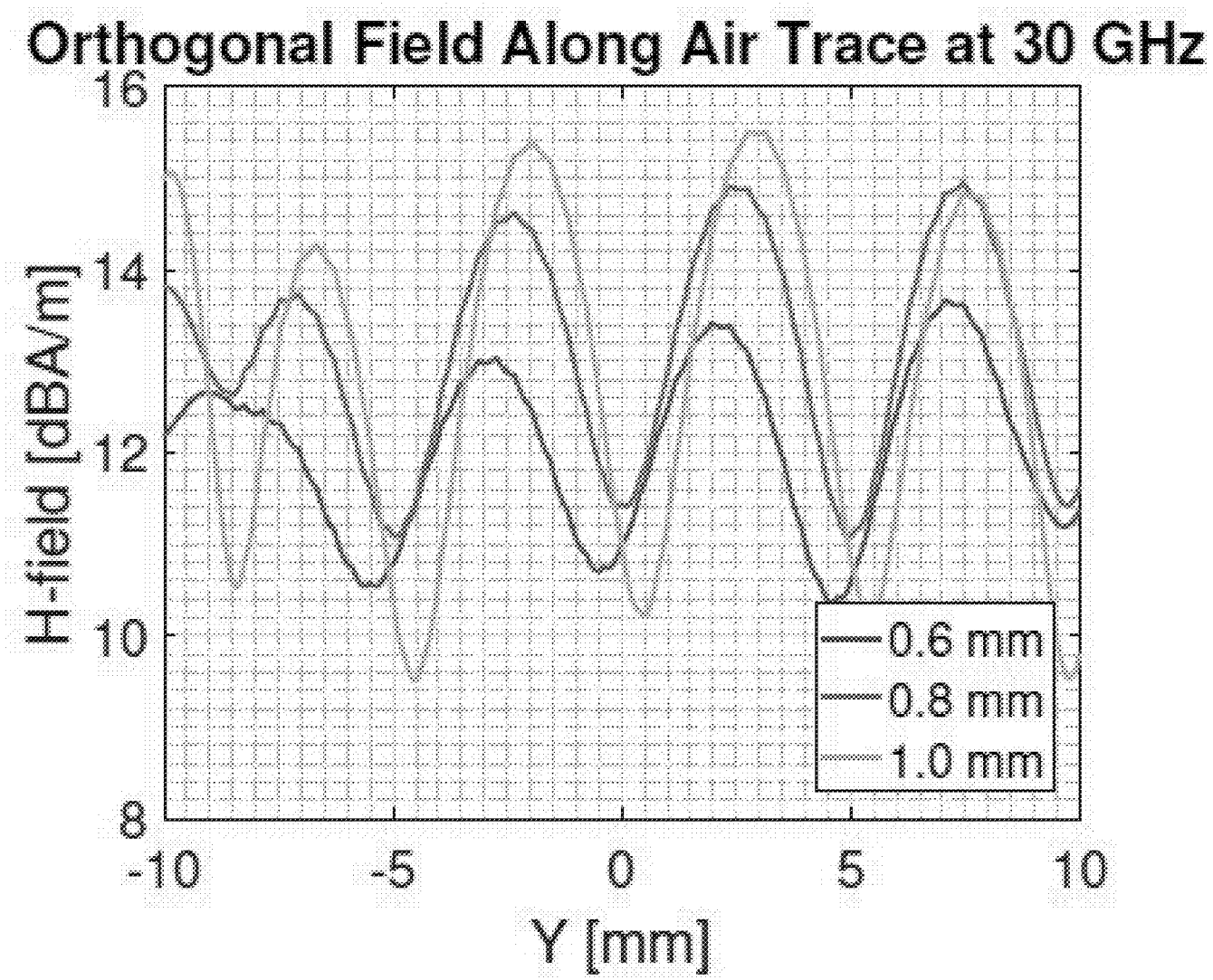
FIG. 15 is a graph illustrating a comparison of tangential fields across an exemplary air trace for various printed circuit board (PCB) thicknesses in accordance with an embodiment of the invention.
Figure 16:
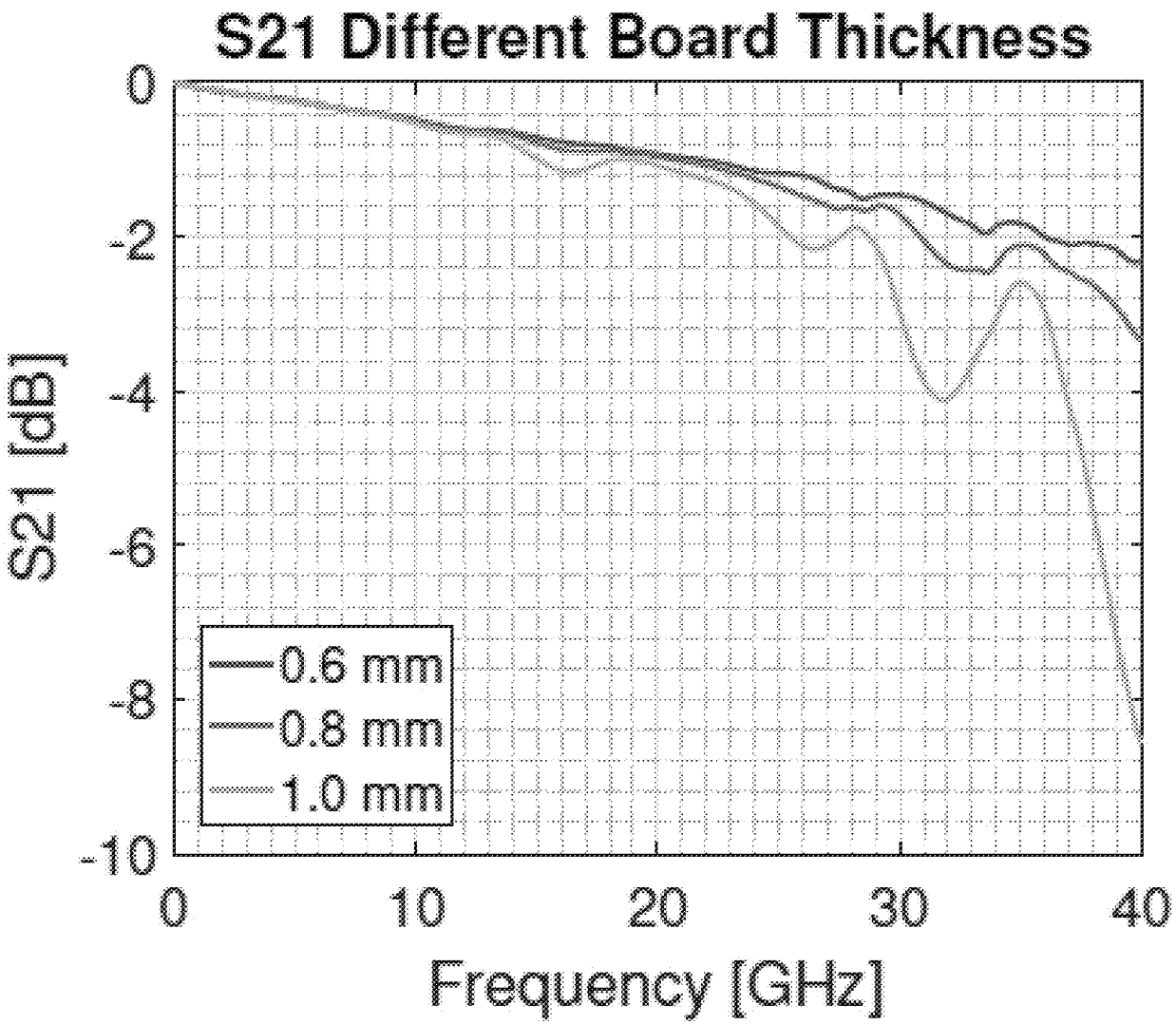
FIG. 16 is a graph illustrating a comparison $S_{21}$ parameters corresponding to an exemplary air trace for various PCB thicknesses in accordance with an embodiment of the invention.

To demonstrate the effects of varying PCB thickness, FIG. 15 provides a comparison of orthogonal fields across the air-dielectric CPW for various PCB thicknesses, and FIG. 16 provides a comparison of $S_{21}$ parameters corresponding to the air-dielectric CPW for various PCB thicknesses. As illustrated, both standing waves and loss are reduced with thinner boards. The variation along the air-dielectric CPW at 30 GHz is reduced to approximately 3 dB for the 0.6 mm board corresponding to the reflections caused by the transition from the connectors (e.g., first connector 340 and/or second connector 350) to the GCPWs.

In another aspect disclosed herein, in order to overcome reflections, it is contemplated that attenuators can be included along the transmission line. However, it should be noted that, since there are two transitions at both ends (e.g., on one end, first connector 340 to first GCPW 360, and first GCPW 360 to air trace 310; and on the opposite end, second connector 350 to second GCPW 370, and second GCPW 370 to air trace 310), four attenuators might be needed, which may cause an undesirably large reduction in the dynamic range.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An integrated transverse electromagnetic (TEM) transmission line structure for probe calibration comprising:

a printed circuit board (PCB); and an air-dielectric coplanar waveguide (CPW), wherein the air-dielectric CPW comprises an air trace in a cutout slot of the PCB, wherein the air trace comprises a copper plating except on each of a first end of the cutout slot and a second end of the cutout slot.

2. The integrated TEM transmission line structure of claim 1, wherein an impedance of the air-dielectric CPW matches an impedance of a grounded CPW (GCPW).

3. The integrated TEM transmission line structure of claim 1, further comprising at least one connector electrically coupled to either a first end of the air-dielectric CPW or an opposite end of the air-dielectric CPW.

4. The integrated TEM transmission line structure of claim 3, wherein an impedance of the at least one connector matches an impedance of the air-dielectric CPW.

5. The integrated TEM transmission line structure of claim 1, wherein the air trace is un-plated.

6. A method comprising:

forming a printed circuit board; and forming an air-dielectric coplanar waveguide (CPW) on the PCB, wherein the air-dielectric CPW comprises an air trace in a cutout slot of the PCB, wherein the air trace comprises a copper plating except on each of a first end of the cutout slot and a second end of the cutout slot.

7. The method of claim 6, further comprising plating the air trace with copper.

8. The method of claim 6, further comprising electrically coupling at least one connector to either a first end of the air-dielectric CPW or an opposite end of the air-dielectric CPW.

9. The method of claim 8, further comprising matching an impedance of the at least one connector with an impedance of the air-dielectric CPW.

10. The method of claim 6, wherein the air trace is un-plated.

11. A system for probe calibration comprising:

an air-dielectric coplanar waveguide (CPW), wherein the air-dielectric CPW comprises an air trace;

a first connector electrically coupled to a first end of the air-dielectric CPW; and a second connector electrically coupled to a second end of the air-dielectric CPW;

wherein the air trace comprises a copper plating except on each of the first end of the cutout slot and the second end of the cutout slot.

12. The system of claim 11, wherein the air trace is un-plated.

13. The system of claim 11, wherein an impedance of each of the first connector and the second connector matches an impedance of the air-dielectric CPW.

14. The system of claim 11, wherein the air-dielectric CPW is configured to transmit signals having a frequency from a very low frequency (VLF) band of radio frequencies to extremely high frequency (EHF) band of radio frequencies.

15. An integrated transverse electromagnetic (TEM) transmission line structure for probe calibration comprising:

a printed circuit board (PCB); and an air-dielectric coplanar waveguide (CPW), wherein the air-dielectric CPW comprises an air trace in a cutout slot of the PCB, wherein an impedance of the air-dielectric CPW matches an impedance of a grounded CPW (GCPW).

16. An integrated transverse electromagnetic (TEM) transmission line structure for probe calibration comprising:

a printed circuit board (PCB);

an air-dielectric coplanar waveguide (CPW), wherein the air-dielectric CPW comprises an air trace in a cutout slot of the PCB;

a first grounded CPW (GCPW) on a first end of the air-dielectric CPW, the first GCPW including a first trace aligned with the air trace; and a second GCPW on a second end of the air-dielectric CPW, the second GCPW including a second trace aligned with the air trace.

17. A method comprising:

forming a printed circuit board;

forming an air-dielectric coplanar waveguide (CPW) on the PCB, wherein the air-dielectric CPW comprises an air trace in a cutout slot of the PCB; and matching an impedance of the air-dielectric CPW with an impedance of a grounded CPW (GCPW).

18. A method comprising:

forming a printed circuit board;

forming an air-dielectric coplanar waveguide (CPW) on the PCB, wherein the air-dielectric CPW comprises an air trace in a cutout slot of the PCB;

forming a first grounded CPW (GCPW) on a first end of the air-dielectric CPW, the first GCPW including a first trace aligned with the air trace; and forming a second GCPW on a second end of the air-dielectric CPW, the second GCPW including a second trace aligned with the air trace.

19. A system for probe calibration comprising:

an air-dielectric coplanar waveguide (CPW), wherein the air-dielectric CPW comprises an air trace;

a first connector electrically coupled to a first end of the air-dielectric CPW;

a second connector electrically coupled to a second end of the air-dielectric CPW;

a first grounded CPW (GCPW) in between a first end of the air-dielectric CPW and the first connector, the first GCPW including a first trace aligned with the air trace; and a second GCPW in between a second end of the air-dielectric CPW and the second connector, the second GCPW including a second trace aligned with the air trace.

* * * * *